US008745772B2

(12) United States Patent
Kido et al.

(10) Patent No.: US 8,745,772 B2
(45) Date of Patent: Jun. 10, 2014

(54) DISCHARGE VALVE APPARATUS AND RINSE WATER TANK APPARATUS FITTED THEREWITH

(75) Inventors: Tsutomu Kido, Fukuoka (JP); Yukinori Kubozono, Fukuoka (JP); Haruki Matsuda, Fukuoka (JP); Hisashi Koga, Fukuoka (JP)

(73) Assignee: Toto Ltd., Fukuoka (JP)

( * ) Notice: Subject to any disclaimer, the term of this patent is extended or adjusted under 35 U.S.C. 154(b) by 124 days.

(21) Appl. No.: 13/442,774

(22) Filed: Apr. 9, 2012

(65) Prior Publication Data

US 2012/0255111 A1 Oct. 11, 2012

(30) Foreign Application Priority Data

Apr. 8, 2011 (JP) ..... 2011-086413

(51) Int. Cl.
*E03D 1/34* (2006.01)

(52) U.S. Cl.
USPC ..... 4/378

(58) Field of Classification Search
USPC ..... 4/353–419
See application file for complete search history.

(56) References Cited

U.S. PATENT DOCUMENTS

| | | | | |
|---|---|---|---|---|
| 6,934,976 | B2 * | 8/2005 | Parsons et al. | 4/378 |
| 2004/0025238 | A1 * | 2/2004 | Parsons et al. | 4/378 |
| 2013/0061381 | A1 * | 3/2013 | Parsons et al. | 4/378 |

FOREIGN PATENT DOCUMENTS

| | | |
|---|---|---|
| JP | 2001-159174 A | 6/2001 |
| JP | 2002-021144 A | 1/2002 |

* cited by examiner

*Primary Examiner* — Lori Baker
(74) *Attorney, Agent, or Firm* — Studebaker & Brackett PC

(57) ABSTRACT

A discharge valve apparatus has control cylinder members for controlling the flow of rinse water flowing out from a reservoir tank discharge port, on which opening portions are formed, and flow-adjusting members attached to these control cylinder members are capable of adjusting the opening surface area of opening portions in the control cylinder member. Female engaging portions in the control cylinder member are arrayed approximately vertically, and are furnished with registration indentations for registering the attachment positions of adjusting members relative to the control cylinder members. Intervals within the registration indentations are set to be smaller than a width of an installer's finger to prevent release of engagement by an installer when the adjusting member male engaging portions are in a state of engagement with the female engaging portions of the control cylinder members.

6 Claims, 10 Drawing Sheets

38
88
28
58a
88a
86a
86
48
50
52e
52a
52b
52
52c
52d
76c
76b
58
92
76
76a
76d
40
40b
84
40a
90d
90d'
90b'
90b
102'
102a'
108a(108)
90c
102b'
96
94
102b
102
L'
94a
102a
62
106
106'
106a
L
108'
96a
104
54
104a
56
90a
74
90
56b
78
56a
56e
80
90h
64
70
82
72
60
80
22a
82
66
68

DISCHARGE VALVE APPARATUS AND RINSE WATER TANK APPARATUS FITTED THEREWITH

TECHNICAL FIELD

The present invention pertains to a discharge valve apparatus and rinse water tank apparatus furnished therewith, and more particularly to a discharge valve apparatus on a rinse water tank for storing rinse water for flushing a toilet, and to a rinse water tank apparatus furnished therewith.

BACKGROUND ART

For some time, known rinse water tank apparatuses such as that set forth in Patent Document 1 (Japanese Patent Unexamined Publication No. 2002-21144) for storing rinse water to flush a toilet have been furnished with a flow regulating cylindrical body disposed to surround the vicinity of a discharge port formed at the bottom portion of the rinse water tank, a float valve (discharge valve) for opening and closing a discharge port disposed on the interior portion of the cylindrical body, and a regulating means (regulating band or the like) capable of regulating the opening surface areas of multiple water passageways formed on the side surface of the cylindrical body.

In conventional discharge valve apparatuses of this type, the amount of rinse water supplied to the toilet can be easily adjusted by regulating the opening surface areas of water passageways in the cylindrical body through manual operation of a regulating means when the float valve releases the discharge port.

SUMMARY OF INVENTION

Technical Problem

The problem arises, however, that while it is true that in the above-described conventional discharge valve apparatus the regulating means for regulating the opening surface area of the water passageways in the cylindrical body can be easily manually operated at the installation site by an installer without use of tools or the like, thereby enabling regulation of the rinse water amount according to the toilet, which is fitted with various types of rinse water tanks, so that the discharge valve apparatus can be used in common for different tanks; by the same token, however, there is also a high probability of easily setting the wrong rinse water amount to be supplied from the rinse water tank to the toilet, so that the desired rinse water amount is not obtained, thus negatively affecting rinse water conservation and toilet flushing performance.

The present invention therefore has the object of providing a discharge valve apparatus and rinse water tank apparatus furnished therewith, undertaken to resolve the above-described problems with conventional technology and capable of preventing easy onsite regulation by an installer of the rinse water mount supplied to the toilet from the rinse water tank.

Solution to Problem

In order to achieve the aforementioned object, the present invention is a discharge valve apparatus on a rinse water tank for storing rinse water for flushing a toilet having: a valve body for opening and closing a discharge port disposed on the bottom surface of a rinse water tank, a control cylinder member for controlling the flow of rinse water flowing out of the discharge port on the rinse water tank when the valve body releases the discharge port, on which an opening portion is formed to permit rinse water to pass through the control cylinder member, and an adjusting member attached at a changeable predetermined attachment position on the control cylinder member, capable of adjusting the opening surface area of an opening portion in the control cylinder member according to this attachment position; whereby the control cylinder member and the adjusting member are respectively furnished with engaging portions by which they can mutually engage, and one of either the control cylinder member engaging portion or the adjusting member engaging portion is a male engaging portion, while the other of either the control cylinder member engaging portion or the adjusting member engaging portion is a female engaging portion; the female engaging portions are arrayed in an essentially straight line fashion, and are furnished with a registration indentation for registering the attachment position of the adjusting member relative to the control cylinder member, and the gap within this registration indentation is set to be smaller than the width of an installer's finger, so that a manipulation by the installer's finger cannot release the engagement between male engaging portions and female engaging portions when the adjusting member engaging portion is in a state of engagement with the control cylinder member engaging portion.

In the present invention thus constituted, the gap in the registration indentation is set to be smaller than the installers finger width in either the control cylinder member engaging portions or the adjusting member engaging portions, thus enabling easy prevention of a state in which the installers finger penetrates into the registration indentation to release the engagement between the male engaging portions and the female engaging portions. I.e., when the adjusting member engaging portions are engaged with the control cylinder member engaging portions, the engagement between the male engaging portions and the female engaging portions cannot be easily released unless the installer uses a tool or other means narrower than the width of a finger, thus preventing easy separation of the adjusting member from the control cylinder member. As a result, since the attachment position of the adjusting member relative to the control cylinder member cannot be easily changed through installer error when installing the rinse water tank or discharge valve apparatus, easy onsite regulation by the installer of the rinse water amount supplied to the toilet from the rinse water tank can be prevented, and the appropriate preset rinse water amount can be supplied to the toilet.

In the present invention the adjusting member engaging portion is preferably the male engaging portion, and the control cylinder member engaging portion is the female engaging portion; the adjusting member is furnished with a blocking portion for blocking the opening portion of the control cylinder member when the adjusting member is attached at a predetermined attachment position on the control cylinder member, and the adjusting member male engaging portion is furnished with a claw-shaped protuberance disposed on at least one side portion of the blocking portion and capable of engaging the registration indentation on the female engaging portion of the control cylinder member.

In the present invention thus constituted, the adjusting member engaging portion can be easily engaged with the control cylinder member engaging portion by engaging the claw-shaped protuberance on the male engaging portion of the adjusting member into the registration indentation on the female engaging portion of the control cylinder member. Moreover, once when the adjusting member engaging portion is engaged with the control cylinder member engaging portion, the engagement between the male engaging portion and the female engaging portion cannot be easily released unless the installer uses a tool or other means narrower than the width of a finger, thus even further preventing a state in which the adjusting member can be easily removed from the control cylinder member. Therefore since the attachment position of the adjusting member relative to the control cylinder member cannot be easily changed through installer error when installing the rinse water tank or discharge valve apparatus, easy onsite regulation by the installer of the rinse water amount supplied to the toilet from the rinse water tank can be prevented, and an appropriate present rinse water amount can be supplied to the toilet.

In the present invention the adjusting member male engaging portion is preferably furnished with a frame-shaped protuberance disposed on the side portion of the blocking portion and forming a vertically extending elongated hole; this frame-shaped protuberance can engage with the registration indentation on one side of the opposing female engaging portion of the control cylinder member, and when the frame-shaped protuberance and the registration indentation on one side are mutually engaged, the claw-shaped protuberance can engage the registration indentation on the other side of the female engaging portion on the control cylinder member opposite the claw-shaped protuberance.

In the present invention thus constituted, when causing the adjusting member to engage the control cylinder member, the claw-shaped protuberance on the female engaging portion of the adjusting member can be easily caused to engage the registration indentation on the other side of the female engaging portion of the control cylinder member when the frame-shaped protuberance on the female engaging portion of the adjusting member is engaged with the registration indentation on one side of the female engaging portion of the control cylinder member. Therefore an adjusting member can be easily attached to the control cylinder member, and assembly of the adjusting member and the control cylinder member is improved. Also, once when the adjusting member engaging portion is engaged with the control cylinder member engaging portion, the engagement between the male engaging portion and the female engaging portion cannot be easily released unless the installer uses a tool or other means narrower than the width of a finger, thus preventing a state in which the adjusting member can be easily removed from the control cylinder member. As a result, since the attachment position of the adjusting member relative to the control cylinder member cannot be easily changed through installer error when installing the rinse water tank or discharge valve apparatus, easy onsite regulation by the installer of the rinse water amount supplied to the toilet from the rinse water tank can be prevented, and an appropriate present rinse water amount can be supplied to the toilet.

In the present invention the control cylinder member is preferably furnished with a side wall on which the opening portion is formed, and the registration indentation on the female engaging portion of the control cylinder member is integrally formed on the side wall.

In the present invention thus constituted, because a registration indentation is integrally disposed on the side wall on which the control cylinder member opening portion is formed, once when the adjusting member engaging portion is engaged with the control cylinder member engaging portion, the engagement between the male engaging portion and the female engaging portion cannot be easily released unless the installer uses a tool or other means narrower than the width of a finger, thus preventing a state in which the adjusting member can be easily removed from the control cylinder member. Since no separate means need be provided for preventing easy release of the engagement between the adjusting member engaging portion and the control cylinder member engaging portion other than the control cylinder member registration indentation, mistaken easy changes by the installer to the attachment position of the adjusting member relative to the control cylinder member can be prevented using a simple structure. An appropriate preset amount of rinse water can therefore be supplied to the toilet.

In the present invention the interval in the registration indentation between the above female engaging portions is preferably set at 13 mm or below.

In the present invention thus constituted, by setting the gap in the female engaging portion registration indentation to 13 mm or below, which is about the level at which the installers finger can be reliably prevented from penetrating, the engagement between the male engaging portion and the female engaging portion cannot be easily released so long as no tool or other means of a width narrower than the width of the installer's finger is used, thus enabling the prevention of easy separation of the adjusting member from the control cylinder member. As a result, since the attachment position of the adjusting member relative to the control cylinder member cannot be easily changed through installer error when installing the rinse water tank or discharge valve apparatus, easy onsite regulation by the installer of the rinse water amount supplied to the toilet from the rinse water tank can be prevented, and an appropriate present rinse water amount can be supplied to the toilet.

The present invention is a rinse water tank apparatus furnished with the above-described discharge valve apparatus.

In the present invention thus constituted, since the attachment position of the adjusting member relative to the control cylinder member cannot be easily changed through installer error when installing the rinse water tank or discharge valve apparatus, easy onsite regulation by the installer of the rinse water amount supplied to the toilet from the rinse water tank can be prevented, and an appropriate present rinse water amount can be supplied to the toilet.

Advantageous Effect of Invention

In the discharge valve apparatus and rinse water tank apparatus furnished therewith of the present invention, easy onsite regulation of the amount of rinse water supplied to the toilet from the rinse water tank can be prevented.

DESCRIPTION OF EMBODIMENTS

Next, referring to the attached drawings, a discharge valve apparatus and rinse water tank apparatus furnished therewith are explained, according to a first embodiment of the present invention.

Figure 1:
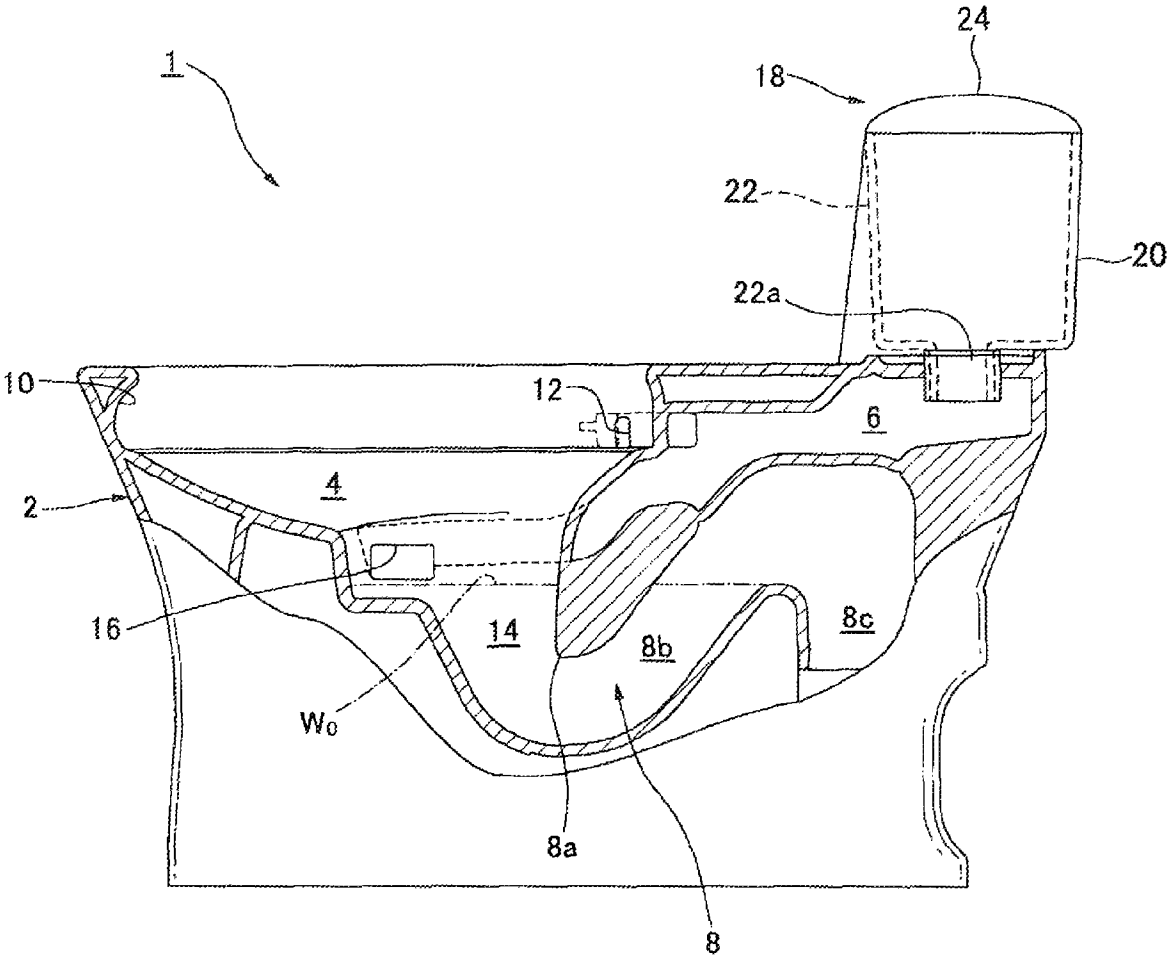
FIG. 1 is a cross-section of a flush toilet to which a rinse water tank apparatus according to a first embodiment of the present invention is applied.

First, referring to FIG. 1, a flush toilet to which a rinse water tank apparatus according to a first embodiment of the present invention is explained.

As shown in FIG. 1, reference numeral 1 indicates a washdown type flush toilet; this toilet 1 is furnished with a toilet main unit 2; respectively formed on the toilet main unit 2 are: a bowl 4, a water conduit 6, and a drain trap line 8 communicating with the lower portion of the bowl 4.

A rim 10, which overhangs on the inner side, and a first water spout port 12 for spouting rinse water supplied from the water conduit 6, are formed on the top edge portion of the toilet main unit 2 bowl 4; rinse water spouted from the first water spout port 12 drops down as it swirls, thereby cleaning the bowl portion.

A reservoir portion 14 on which a reservoir surface W0 is shown by a dot and dash line in the lower part of the bowl 4. An intake 8*a* opens in the drain trap line 8 beneath the reservoir portion 14, and a rising route 8*b* extends rearward from this intake 8*a*. A dropping route 8*c* continues from the rising route 8*b*, and the bottom end of the dropping route 8*c* is connected to an under-floor discharge pipe (not shown) via a waste water socket (not shown). A second water spout port 16 for spouting rinse water supplied from the water conduit 6 is formed at a position above the bowl 4 reservoir surface W0; rinse water spouted from this second water spout port 16 causes a swirling flow inducing the accumulated water in the reservoir portion 14 to swirl up and down.

A rinse water tank apparatus 18 (details described below) for storing rinse water supplied to the toilet main unit 2 is disposed above the toilet main unit 2 water conduit 6.

The rinse water tank apparatus 18 is furnished with a ceramic finished tank 20, a reservoir tank 22 disposed integrally on the inside of this ceramic finished tank 20, and a cover body 24 mounted on the ceramic finished tank 20.

A discharge port 22*a* communicating with the toilet main unit 2 water conduit 6 is formed at the bottom portion of the reservoir tank 22, and rinse water in the reservoir tank 22 is discharged to the water conduit 6. The amount of rinse water stored in the reservoir tank 22 differs depending on toilet type.

Note that the rinse water tank apparatus 18 according to the present embodiment could also be applied to other types of flush toilets beyond the above-described washdown type (e.g., siphon type flush toilets, etc.).

Figure 2:
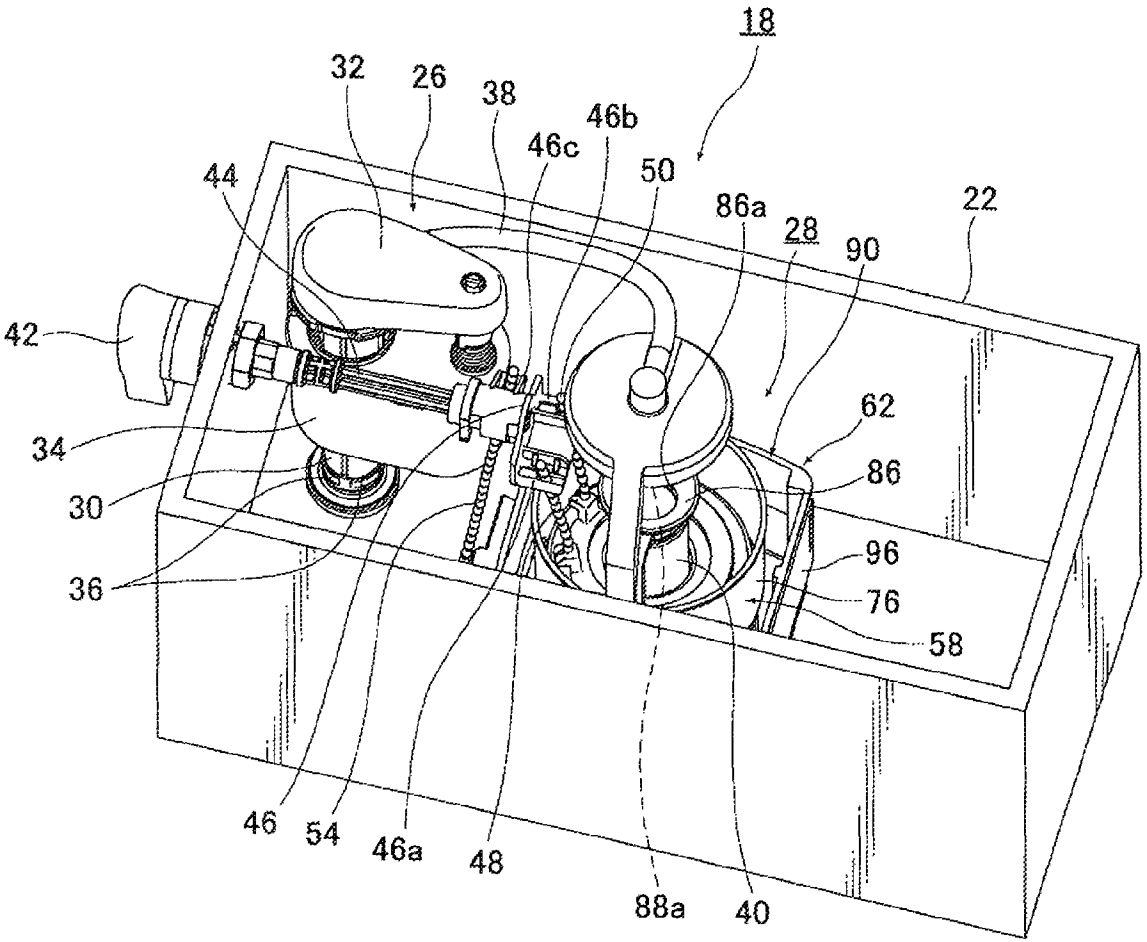
FIG. 2 is a perspective view seen diagonally from forward and above of the structure inside a reservoir tank on a rinse water tank apparatus according to a first embodiment of the present invention, with the cover removed.
Figure 3:
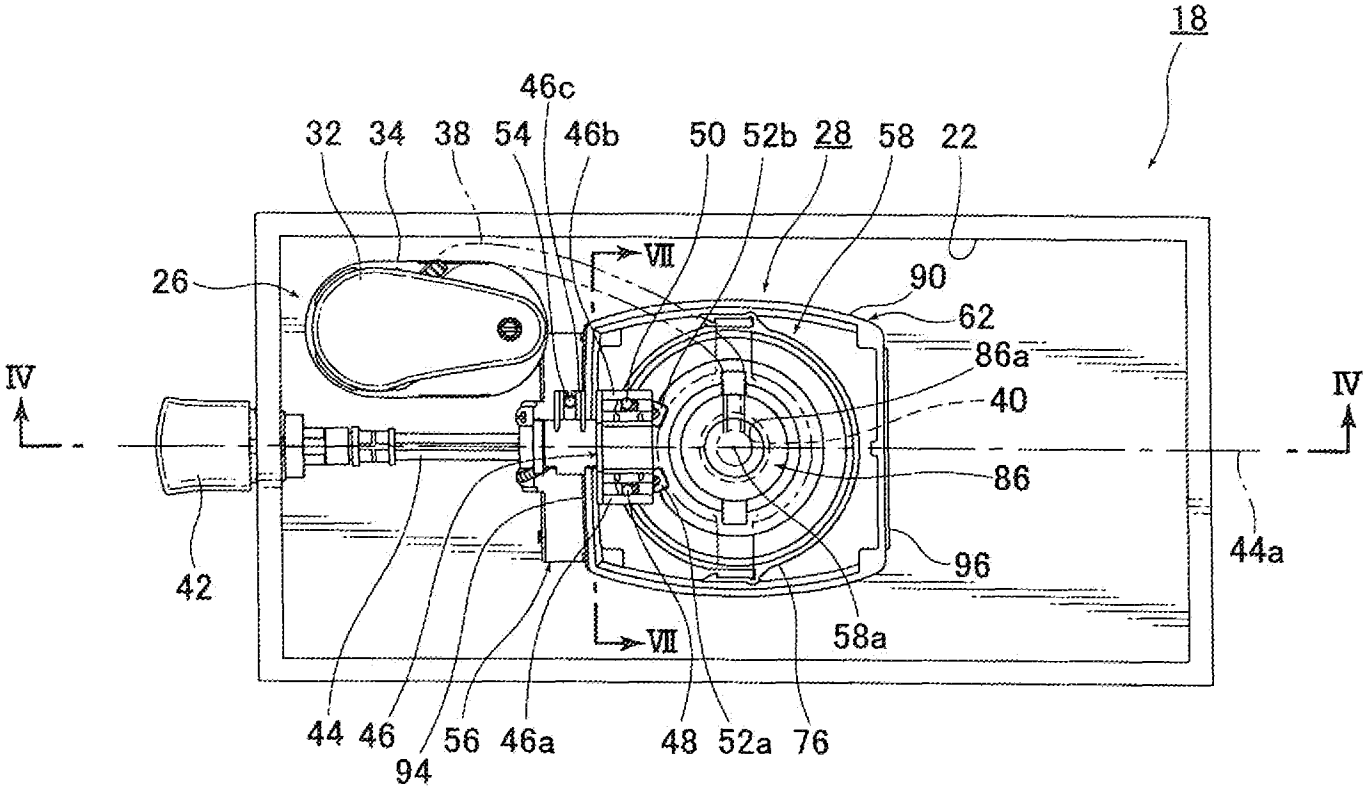
FIG. 3 is a plan view showing the structure inside the reservoir tank of a rinse water tank apparatus according to a first embodiment of the present invention.
Figure 4:
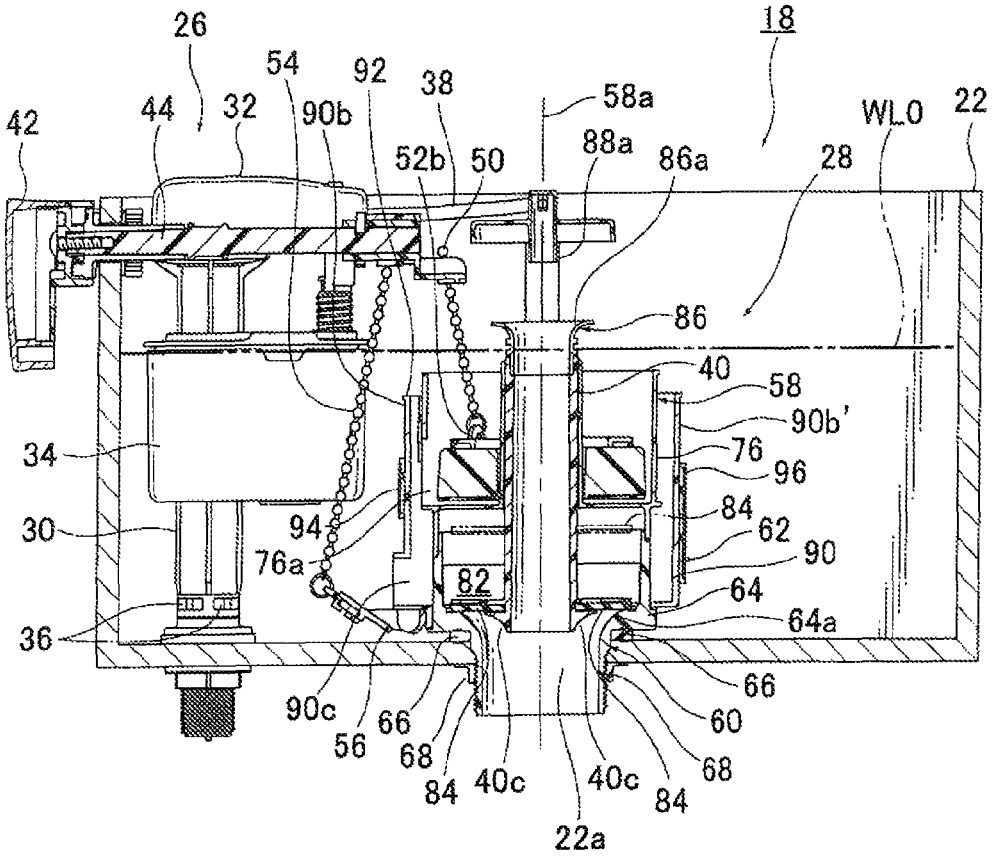
FIG. 4 is a cross-section seen along line IV-IV in FIG. 3.

Next, referring to FIGS. 2 through 4, details of the rinse water tank apparatus 18 are explained.

As shown in FIGS. 2 through 4, a water supply apparatus 26 for supplying rinse water into the reservoir tank 22, and a discharge valve apparatus 28 for opening the discharge port 22*a* and causing rinse water stored in the reservoir tank 22 to flow out to the toilet main unit 2 water conduit 6, are disposed inside the reservoir tank 22 of the rinse water tank apparatus 18.

The water supply apparatus 26 is furnished with a water supply pipe 30 extending upward from the bottom portion of reservoir tank 22 connected to an external water supply, a water supply valve 32 attached to the top end portion of the water supply pipe 30 for switching between spouting and stopping rinse water supplied from the water supply pipe 30 into the reservoir tank 22, and a float 34, which moves up and down in response to water level fluctuations in the reservoir tank 22, thereby switching between the spouting and stopping of water by the water supply valve 32.

The water spout port 36 opens at the outer circumference-side bottom end portion of the water supply pipe 30, and rinse water from the water supply valve 32 is spouted into the reservoir tank 22 from the water spout port 36.

The water supply apparatus 26 is further furnished with a refill pipe 38 connected to the water supply valve 32, and the downstream end of the refill pipe 38 is positioned over the top end opening of the overflow pipe 40 of the discharge valve apparatus 28, described below.

In the water supply apparatus 26, when rinse water in the reservoir tank 22 is discharged by the discharge valve apparatus 28 into the reservoir tank 22, the rinse water level falls and float 34 drops, causing the water supply valve 32 to open and spouting of spout water from the water spout port 36 to commence, so that spouting into the reservoir tank 22 is started. Next, as spouting continues and the water level rises, float 34 also rises, causing water supply valve 32 to close and water spout port 36 to be turned off. The level of rinse water in the reservoir tank 22 can thus be maintained at a predetermined full water level.

Next, referring to FIGS. 2 through 16, the discharge valve apparatus 28 is explained in detail.

As shown in FIGS. 2 through 5, the discharge valve apparatus 28 is furnished with an operating lever 42 attached to the exterior of the reservoir tank 22, and a rotating shaft 44, one end of which is attached to the operating lever 42 and the other end of which extends into the reservoir tank 22 and is rotated by operation of the operating lever 42.

As one example of the present embodiment, regarding at the operating lever 42 and the rotating shaft 44, a manual operation for rotating the rotating shaft 44 by a user directly rotating the operating lever 42 is explained, but the embodiment is not limited to this form, and may also take an operating form whereby a drive means such as a motor is provided to rotate the operating lever 42 and rotating shaft 44, and activation of the drive means is automatically controlled by command signals from an externally disposed operating button (not shown) or a human presence sensor (not shown).

A bead chain pull up member 46, which rotates around the center axis line 44*a* of the rotating shaft 44 as the rotating shaft 44 rotates, is integrally attached to the other end of the rotating shaft 44.

In the bead chain pull up member 46, a first bead attaching portion 46*a* is provided, to which a first bead chain 48 is attached at one side of the rotating shaft 44 center axis line 44*a* so as to move up and down with rotation of the rotating shaft 44, and a second bead attaching portion 46*b* is disposed to which a second bead chain 50 is attached at the other side of the rotating shaft 44 center axis line 44*a* so as to move up and down with the rotation of the rotating shaft 44.

A first bead chain attaching portion 52*a* and second bead chain attaching portion 52*b* on a float member 52 are respectively attached to the bottom ends of the first bead chain 48 and the second bead chain 50.

Also, a third bead chain attaching portion 46*c* is provided on the bead chain pull up member 46, to which a third bead chain 54 is attached, moving up and down by the rotation of the rotating shaft 44 at a predetermined position adjacent to the operating lever 42 side from the second bead attaching portion 46*b*, and the bottom end of the third bead chain 54 is attached to a switching valve 56 third bead chain attaching portion 56*a*, described below.

When the operating lever 42 is turned in one direction, the bead chain pull up member 46 rotates in a predetermined direction together with the rotating shaft 44, and only the first bead chain 48 is lifted up by the bead chain pull up member 46, whereas the second bead chain 50 and the third bead chain 54 in a slackened state; with the switching valve 56 remaining open, the valve body 84, described below, rises together with the float member 52, and water discharge is commenced in the large flush mode described below.

At the same time, when the operating lever 42 is turned in the other direction the second bead chain 50 and the third bead chain 54 are pulled up by the bead chain pull up member 46 with the first bead chain 48 in a slackened state; as the float member 52 and the valve body 84 rise, the switching valve 56 closes, and water discharge is commenced in the small flush mode described below.

The center axis line 44*a* of the rotating shaft 44 passes through a center axis line 58*a*; the gap between the first bead attaching portion 46*a* and the second bead attaching portion 46*b* of the bead chain pull up member 46 is set to be essentially the same as the gap between the first bead chain attaching portion 52*a* and the second bead chain attaching portion 52*b* of the float member 52.

Figure 5:
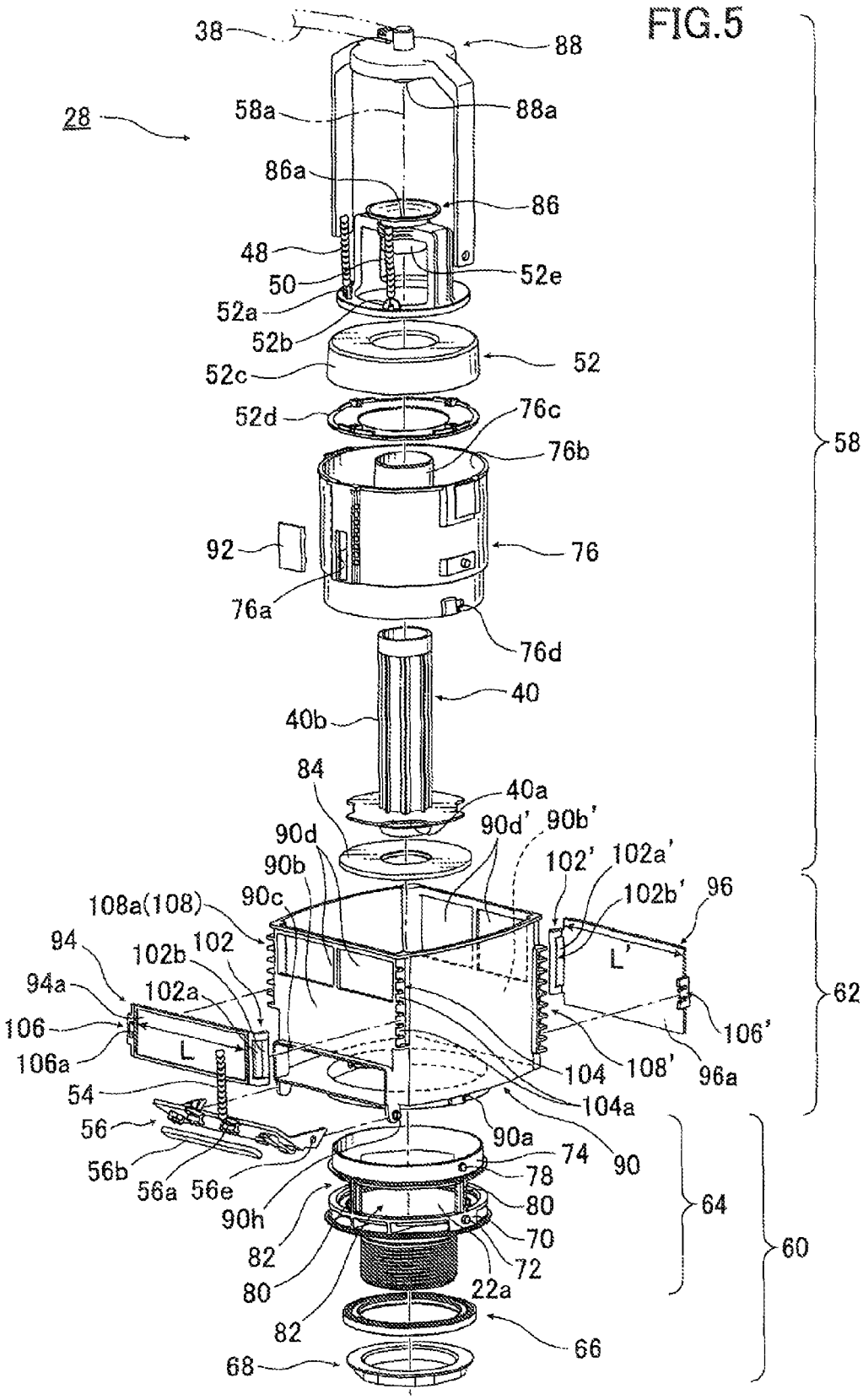
FIG. 5 is an expanded perspective view of a rinse water tank discharge valve apparatus according to a first embodiment of the present invention.
Figure 6:
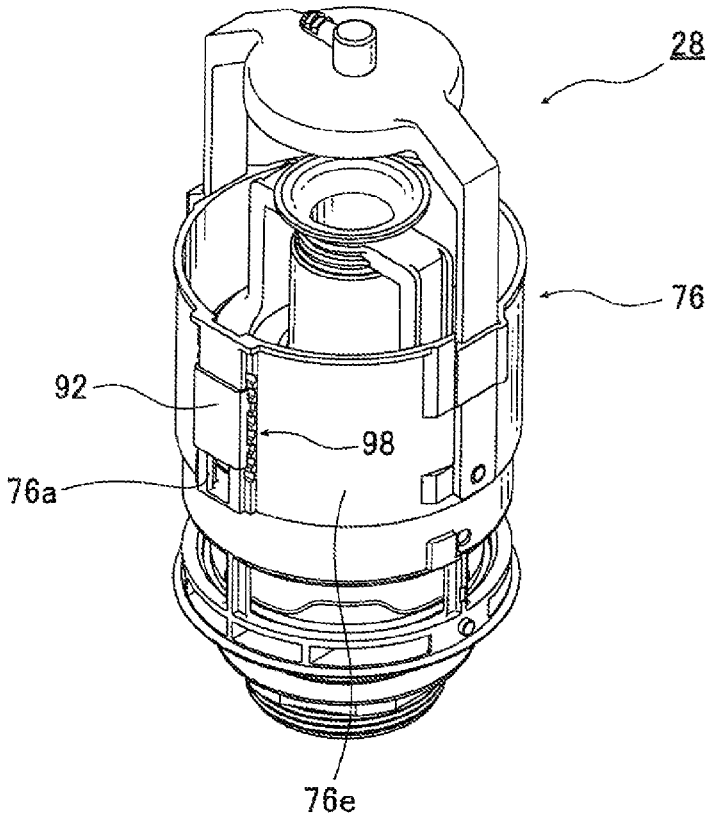
FIG. 6 is a perspective view showing a state in which an outside control cylinder member has been removed in a rinse water tank discharge valve apparatus according to a first embodiment of the present invention.
Figure 7:
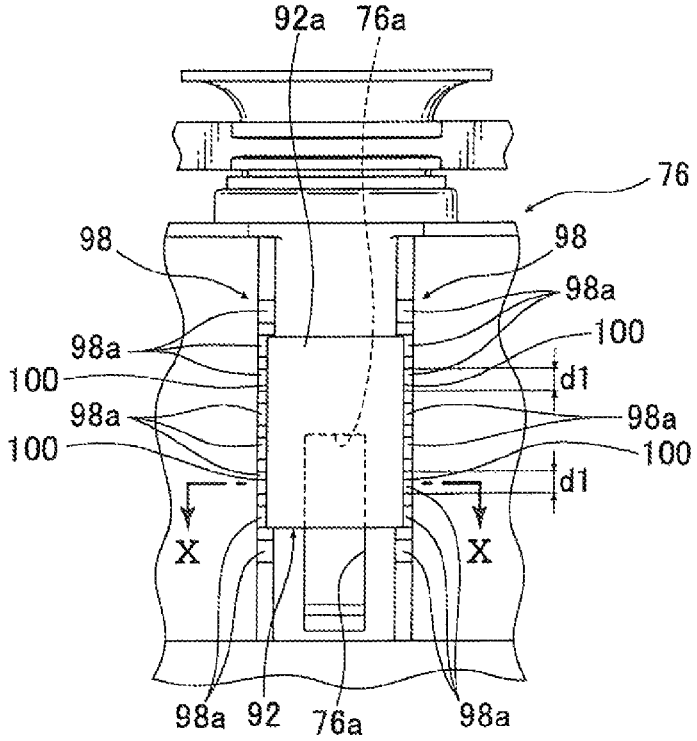
FIG. 7 is an expanded view showing a flow regulating member attached to the inside control cylinder member in a rinse water tank discharge valve apparatus according to a first embodiment of the present invention.
Figure 8:
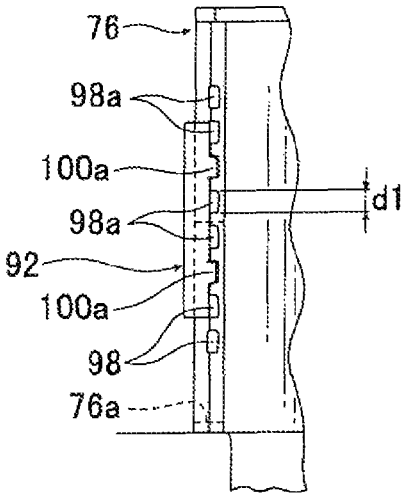
FIG. 8 is a front elevation expanded view showing a regulating member attached to the inside control cylinder member in a rinse water tank discharge valve apparatus according to a first embodiment of the present invention.
Figure 9:
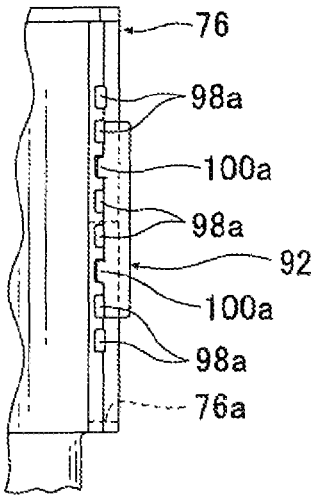
FIG. 9 is a rear elevation expanded view showing an inside control cylinder member adjusting member in a rinse water tank discharge valve apparatus according to a first embodiment of the present invention.

The discharge valve apparatus 28 is furnished, as shown in FIG. 5, with a discharge port unit 60 attached to the bottom surface of the reservoir tank 22 and forming a discharge port 22*a* communicating with the toilet main unit 2 water conduit 6, a discharge valve unit 58 attached to the top end of the discharge port unit 60, and an outside control cylinder member 62 attached to the discharge port unit 60 so that it can be attached and removed from above.

As shown in FIG. 5, the discharge valve apparatus 28 discharge port unit 60 is furnished with a discharge port-forming member 64 attached at a predetermined position on the bottom surface of the reservoir tank 22 and forming a discharge port 22*a*.

The bottom end portion of the discharge port-forming member 64 penetrates the bottom surface of the reservoir tank 22 and is tightened by a tightening member 68 mediated by a seal member 66, and the discharge port-forming member 64 is affixed to the bottom surface of the reservoir tank 22.

The discharge port-forming member 64 is furnished with a discharge port top edge portion 70 forming the upper edge of the discharge port 22*a*; holding protuberances 72 are formed at predetermined opposing positions on the perimeter of the discharge port top edge portion 70 to permit attachment of the outside control cylinder member 62 in such a way that it can be attached and detached from above.

Moreover, holding protuberances 78 are formed at predetermined opposing positions on the outer perimeter of a top end opening portion 74 on the discharge port-forming member 64, with which a discharge port unit 60 inside control cylinder member 76, described below, can be attached and detached from above.

Discharge port-forming member 64 is furnished with multiple ribs 80 extending vertically and spaced at predetermined intervals along the circumference between the discharge port top edge portion 70 and the top end opening portion 74; multiple communicating ports 82 for causing rinse water outside the inside control cylinder member 76 to flow into the discharge port 22*a* are formed by these ribs 80.

Next, as shown in FIG. 5, the discharge valve apparatus 28 discharge valve unit 58 is furnished with a valve body 84, an overflow pipe 40, an inside control cylinder member 76, a float member 52, an overflow pipe attaching member 86, and a refill pipe attaching member 88.

The valve body 84 is made up of a seal member such as sheet packing; as shown in FIG. 5, it is snapped onto a valve holding portion 40*a* at the bottom end portion of the overflow pipe 40 and affixed, moving up and down with the overflow pipe 40 and functioning as a discharge valve for opening and closing the discharge port 22*a*.

The inside control cylinder member 76 is made to function as a device for controlling the up and down movement of the valve body 84, and is furnished with an approximately cylindrical reservoir portion 76*b*, on the side surface of which is formed an opening 76*a* for causing stored rinse water to flow out at a predetermined flow rate as the rinse water is stored, an approximately cylindrical guide portion 76*c* extending upward from the center of the bottom portion of the reservoir portion 76*b*, and one or multiple engaging channel 76*d* formed at the bottom end portion of the reservoir portion 76*b* and engaged by the holding protuberance 78 on the discharge port-forming member 64 of the discharge port unit 60. This engaging channel 76*d* forms an approximately L-shaped keyhole channel; after enabling the holding protuberance 78 to be pushed in from below, the engaging channel 76*d* can be moved horizontally to engage the holding protuberance 78.

A flow-adjusting member 92, described in detail below, is attached to the opening 76*a* on the inside control cylinder member 76 reservoir portion 76*b*; the opening surface area of the opening 76*a* can be adjusted by changing the position at which the flow-adjusting member 92 is attached in the up or down direction.

The float member 52 is furnished with a thin profile, approximately ring-shaped, float portion 52*c* contained within the inner circumference of the inside control cylinder member 76 reservoir portion 76*b* and the outer circumference side of the guide portion 76*c*, and a bottom portion 52*d* to which the bottom end of the float portion 52*c* is attached; an interior space is formed by the inside of the float portion 52*c* and the bottom portion 52*d*. When rinse water is being stored in the reservoir portion 76*b* of the inside control cylinder member 76, the float portion 52*c* and bottom portion 52*d* are contained in a floating state within the inside control cylinder member 76 reservoir portion 76*b* due to buoyancy, and as the level of rinse water in the inside control cylinder member 76 reservoir portion 76*b* falls, they also fall, guided by the inside control cylinder member 76 guide portion 76*c*.

Furthermore, the float member 52 and is furnished with an overflow pipe attaching portion 52*e*, which is affixed to the top end of the float 52*c* and extends upward by a predetermined distance, then extends radially inward in an arced shape, and to which the top end of the cylindrical portion 40*b* of the overflow pipe 40 is attached.

The cylinder portion 40*b*, which vertically extends in the overflow pipe 40, is inserted into the inner circumference side of the inside control cylinder member 76 guide portion 76*c*, and is slidably guided in the vertical direction.

In addition, the top end of the overflow pipe 40 cylinder portion 40*b* is attached to the float member 52 overflow pipe attaching portion 52*e*, and is affixed by the overflow pipe attaching member 86.

The overflow pipe attaching member 86 in substance forms an inflow port 86*a* at the top end of the overflow pipe 40 for inflow of rinse water exceeding a predetermined water level (full water level) within the reservoir tank 22.

The inflow port 86*a* at the top end of the overflow pipe 40 is trumpet-shaped, gradually widening upward and outward relative to the pipe diameter of the overflow pipe 40, and rinse water exceeding a predetermined water level (full water level) within the reservoir tank 22 is reliably discharged out of the reservoir tank 22 by the overflow pipe 40.

Furthermore, the refill pipe attaching member 88 is furnished with a nozzle portion 88*a* to which the downstream end of the above-described refill pipe 38 is connected, and the opening at the bottom end portion of the nozzle portion 88*a* is positioned above the overflow pipe 40 inflow port 86*a*.

Next, as shown in FIG. 5, the outside control cylinder member 62 is furnished with a cylinder main body 90 formed in an approximately rectangular cross-sectional shape and open at the top. The bottom end portion of the cylinder main body 90 forms an opening into which the discharge port-forming member 64 of the discharge port unit 60 can be vertically inserted; one or multiple engaging channels 90*a* are provided on the perimeter edge of the bottom end portion of the cylinder main body 90, capable of attaching and detaching the holding protuberance 72 on the discharge port-forming member 64 of the discharge port unit 60 by rotating the cylinder main body 90 around the center axis line thereof (corresponding to the discharge valve unit 58 center axis line 58*a*).

This engaging channel 90*a* forms an approximately L-shaped keyhole channel; after enabling the holding protuberance 72 to be pushed in from below, the engaging channel 90*a* can be made to engage the holding protuberance 72 by moving it horizontally.

When the cylinder main body 90 engaging channel 90*a* is engaged with the holding protuberance 72 on discharge port-forming member 64 of the discharge port unit 60, the cylinder main body 90 side wall 90*b* proximal to the operating lever 42 (the "proximal side wall 90*b*" below) extends upward from the bottom surface of the reservoir tank 22 to surround a portion of the discharge port unit 60 and the inside control cylinder member 76; an opening portion 90*c* penetrating the proximal side wall 90*b* for switching flush modes is formed on the proximal side wall 90*b* of this cylinder main body 90.

A switching valve 56 (described below in detail) permitting opening and closing of the opening portion 90*c* is attached to the side wall 90*b* of the cylinder main body 90; a weight 56*b* is removably attached to this switching valve 56. When the switching valve 56 has released opening portion 90*c*, discharge proceeds in the large flush mode, when the switching valve 56 has closed opening portion 90*c*, discharge proceeds in the small flush mode.

Proximal side openings 90*d* for adjusting flow are formed above the opening portion 90*c* on the cylinder main body 90 proximal sidewall 90*b*; a proximal flow-adjusting member 94 is attached to these proximal openings 90*d*.

Similarly, distal side openings 90*d*' ("distal sidewalls 90*d*'" below) for adjusting flow are also formed on the sidewall 90*b*' opposite the cylinder main body 90 proximal sidewall 90*b*, and a distal flow-adjusting member 96, described in detail below, is also attached to these distal side openings 90*d*'.

By vertically changing the positions at which the proximal flow-adjusting member 94 and distal flow-adjusting member 96 are respectively attached, and by adjusting the opening surface area of the respectively corresponding openings 90*d* and 90*d*', the flow of rinse water in the reservoir tank 22 from the cylinder main body 90 openings 90*d* and 90*d*' into the cylinder main body 90 can, in the small flush mode be adjusted, as can the amount of rinse water flowing out of the reservoir tank 22.

Also, when the engaging channel 76*d* in the inside control cylinder member 76 is engaged by the holding protuberance 78 on the discharge port-forming member 64 of the control tube attachment discharge port unit 60, and the engaging channel 90*a* on the cylinder main body 90 is engaged on the holding protuberance 72 on the discharge port-forming member 64 of the discharge port unit 60, the multiple communicating ports 82 formed on the side surface of the discharge port-forming member 64 extending from the bottom portion of the inside control cylinder member 76 up to the discharge port 22*a* serve as communicating ports bringing the interior of the cylinder main body 90 into communication with the discharge port 22*a*, and the cylinder main body 90 opening portion 90*c* for switching flush mode is disposed at a height at or below the top end of these communicating ports 82.

Immediately after commencement of discharge in the large flush mode and the small flush mode, the discharge valve unit 58 and valve body 84 rise to a predetermined maximum height position where they touch the bottom portion of the inside control cylinder member 76, as in the valve body 84 shown by the dotted line in FIG. 4; the height position of this valve body 84 is set to a height position at or greater than the top end of the opening portions 90*c* for switching flush modes on the cylinder main body 90.

In addition, as shown in FIG. 4, the opening 76*a* in the reservoir portion 76*b* of the inside control cylinder member 76 is also set to a height position equal to or higher than the top end of the opening portion 90*c* for changing flush modes in the cylinder main body 90.

Next, referring to FIGS. 6 through 10, details of the flow-adjusting member 92 attached to the inside control cylinder member 76 on the discharge valve apparatus 28 are explained.

As shown in FIGS. 6 through 10, the inside control cylinder member 76 and flow-adjusting member 92 are each furnished with mutually engaging portions 98 and 100; the engaging portions 98 on the inside control cylinder member 76 serve as female engaging portions ("female engaging portions 98" below), and the engaging portions 100 on the flow-adjusting member 92 serve as male engaging portions capable of engaging with the inside control cylinder member 76 female engaging portions 98 ("male engaging portion 100" below).

The female engaging portions 98 on the inside control cylinder member 76 are disposed as an integral piece with the wall portions 76*e* on both sides of the opening 76*a* in the inside control cylinder member 76, and are furnished with multiple registration indentations 98*a* for registering the attachment position of the flow-adjusting member 92. Each of these multiple registration indentations 98*a* is depressed inward in the wall portions 76*e* of the inside control cylinder member 76, and is arrayed vertically in approximately a straight line.

Note that each of the multiple registration indentations 98*a* may be arrayed in approximately a straight line in the left-right direction on the wall portions 76*e* on both the top and bottom side of the opening 76*a* on the inside control cylinder member 76 to register the flow-adjusting member 92 in the left-right direction.

The flow-adjusting member 92 is furnished with a blocking portion 92*a* for blocking the opening 76*a* in the inside control cylinder member 76 when attached to the inside control cylinder member 76 at a predetermined position. At the flow-adjusting member 92 attachment position shown in FIG. 7, the blocking portion 92*a* is blocking the opening region from a position approximately half the height of the opening 76*a* in the inside control cylinder member 76.

Figure 10:
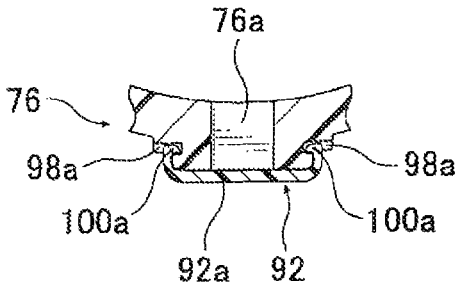
FIG. 10 is a cross-section seen along line X-X in FIG. 7.
Figure 11:
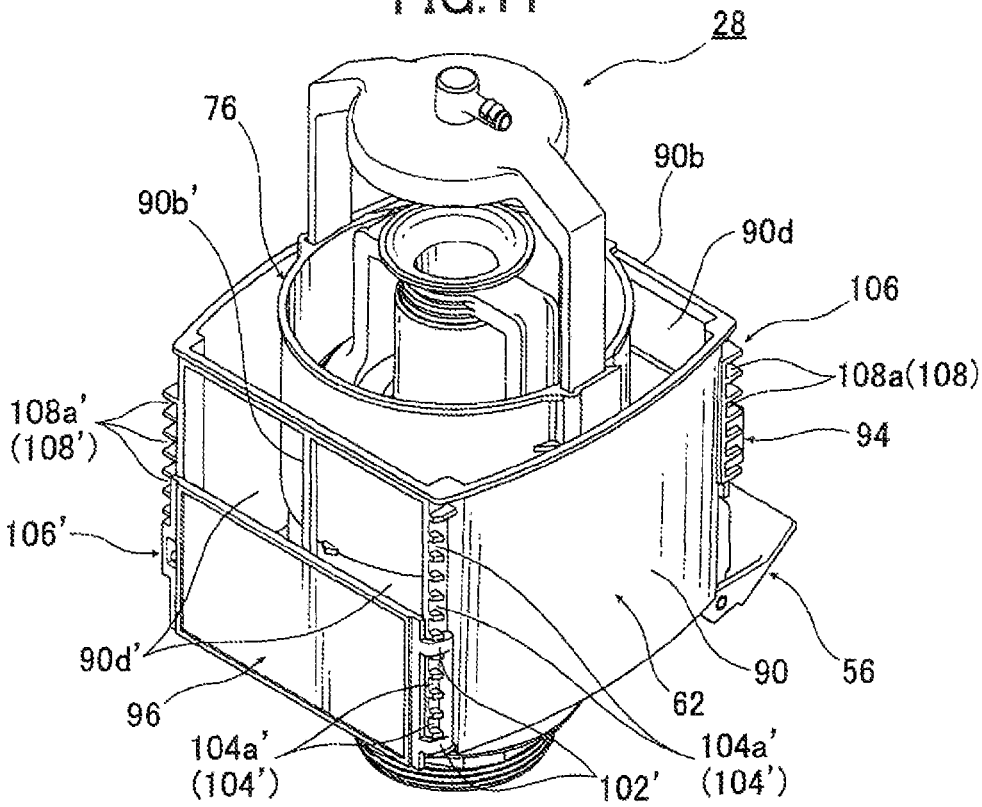
FIG. 11 is a perspective view seen diagonally from the rear and above of a rinse water tank discharge valve apparatus according to a first embodiment of the present invention.
Figure 12:
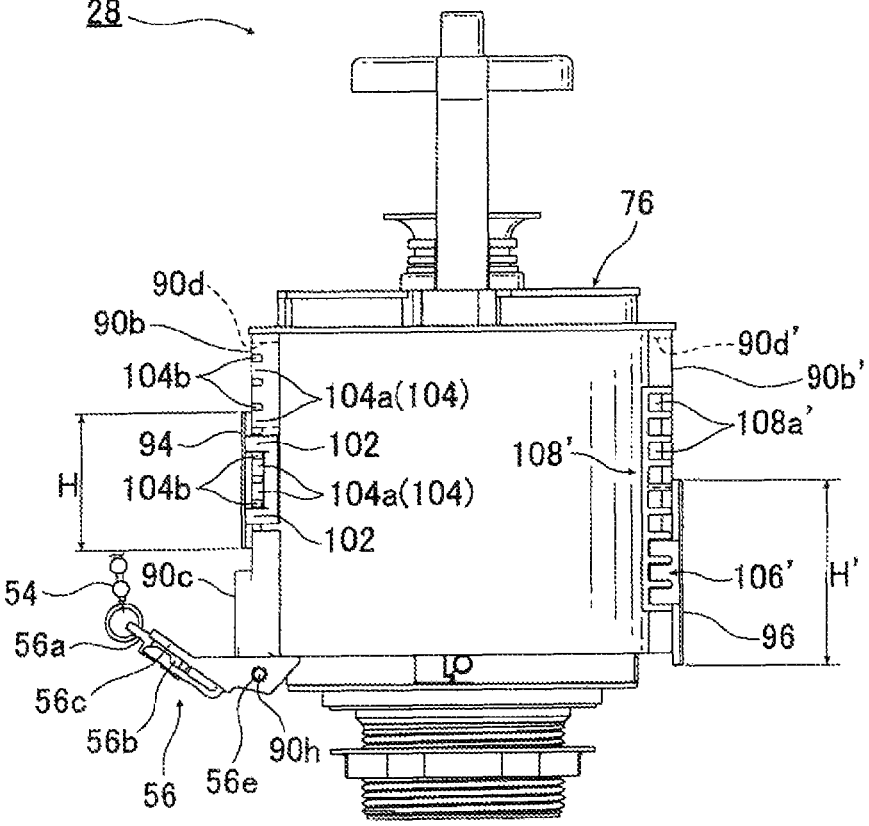
FIG. 12 is a front elevation showing a rinse water tank discharge valve apparatus according to a first embodiment of the present invention.

The male engaging portions 100 on the flow-adjusting member 92 are in particular disposed at a predetermined spacing in the vertical direction on the blocking portion 92*a*, as shown in FIG. 10, and are furnished with claw-shaped protuberances 100*a* capable of engaging with the registration indentations 98*a* on the engaging portions of the inside control cylinder member 76.

For example, the higher the attachment position is set for attaching these flow-adjusting member 92 claw-shaped protuberances 100*a* to the inside control cylinder member 76 registration indentations 98*a*, the larger the opening surface area in the inside control cylinder member 76 opening 76*a* becomes, thereby increasing the flow of rinse water in the inside control cylinder member 76 reservoir portion 76*b* from the opening 76*a* when the discharge valve apparatus 28 discharges, thus causing the float member 52 and valve body 84 to fall more quickly at discharge.

In addition, the intervals d1 in the vertical direction within the indentations in the multiple registration indentations 98*a* of the female engaging portions 98 on the inside control cylinder member 76 are all equal, and it is preferable that they be smaller than the width of an installer's finger, so that when the claw-shaped protuberances 100*a* on the flow-adjusting member 92 male engaging portions 100 are engaged with the registration indentations 98*a* on the female engaging portions 98 of the inside control cylinder member 76, the two engaging portions 98 and 100 cannot be disengaged by the installer's fingers.

I.e., it is preferable to set the intervals d1 in the vertical direction within the indentation in the registration indentations 98*a* to 13 mm or below, and more preferable to set them to 5 mm or below.

Note that in the present embodiment, as one example of the engaging between the inside control cylinder member 76 and the flow-adjusting member 92 in the discharge valve apparatus 28, a configuration, in which the inside control cylinder member 76 female engaging portions 98 were female engaging portions and the flow-adjusting member 92 engaging portions 100 were male engaging portions, is explained, but the embodiment is not limited to this configuration, and a configuration in which the inside control cylinder member 76 engaging portions 98 are male engaging portions and the flow-adjusting member 92 engaging portions 100 are female engaging portions would also be acceptable.

Next, referring to FIGS. 11 through 16, details of the outside control cylinder member 62 in the discharge valve apparatus 28, and the proximal flow-adjusting member 94 and distal flow-adjusting member 96 attached to the outside control cylinder member 62 are explained.

As shown in FIG. 5 and FIGS. 11 through 16, in the proximal openings 90*d* formed on the proximal sidewall 90*b* of the cylinder main body 90 in the outside control cylinder member 62, the cross-sectional shape of the opening is rectangular, and two openings of equal opening surface areas are disposed in the front and rear.

Similarly, in the proximal openings 90*d*' formed on the distal sidewall 90*b*' of the cylinder main body 90 in the outside control cylinder member 62, the opening cross-sectional shape is also rectangular, and two openings of equal opening surface areas are disposed in the front and rear.

The top edge of both the proximal openings 90*d* and both openings of the distal sidewall 90*d*' are at approximately equal height positions, but the bottom edge of the two openings in the distal sidewall 90*d*' is above the top edge of the opening portion 90*c*, and is below the bottom edge of the two proximal openings 90*d*.

Therefore when the entire opening cross-section of both opening portions 90*d* and 90*d*' is opened, the full opening surface area of the opening 90*d* is smaller than the full opening surface area of the 90*d*'.

As shown in FIG. 5 and FIGS. 11-16, the outside control cylinder member 62 is furnished with female engaging portions 104, integrally disposed on the front surface side of the proximal sidewall 90*b* of the cylinder main body 90 and engaging the male engaging portions 102 of the proximal flow-adjusting member 94, and with female engaging portions 108 disposed on the rear surface side of the cylinder main body 90 and engaging the male engaging portions 106 of the proximal flow-adjusting member 94.

Also, the outside control cylinder member 62 is furnished with female engaging portions 104 integrally disposed on the rear surface side of the cylinder main body 90 and engaging the male engaging portions 102' of the distal flow-adjusting member 96, and with female engaging portions 108' disposed on the front surface side of the distal sidewall 90*b*' of cylinder main body 90 and engaging the male engaging portions 106' of the distal flow-adjusting member 96.

The female engaging portions 104 and 108 on the outside control cylinder member 62 are respectively furnished with multiple registration indentations 104*a* and 108*a* for registering the attachment position of the proximal flow-adjusting member 94. The multiple registration indentations 104*a* and 108*a* are each depressed inward on the proximal sidewall 92*b* of the outside control cylinder member 62, and are vertically arrayed in approximately a straight line.

Similarly, female engaging portions 104' and 108' on the outside control cylinder member 62 are respectively furnished with multiple registration indentations 104*a'* and 108*a'* for registering the attachment position of the distal flow-adjusting member 96. The multiple registration indentations 104*a'* and 108*a'* are each depressed inward on the distal sidewall 92*b'* of the outside control cylinder member 62, and are vertically arrayed in approximately a straight line.

Note that each of the indentations in the registration indentations 104*a* on the female engaging portions 104 and the registration indentations 104*a'* of the female engaging portions 104' in the outside control cylinder member 62 have mutually the same configurations, but more registration indentations 104*a'* are arrayed than the number of indentations in the registration indentations 104*a*.

Also, each of the indentations in the registration indentations 108*a* on the female engaging portions 108 and the registration indentations 108*a'* on the female engaging portions 108' in the outside control cylinder member 62 has mutually the same configurations, but a greater number of registration indentations 108*a'* are arrayed than the number of indentations in the registration indentations 108*a*.

In addition, the proximal flow-adjusting member 94 and distal flow-adjusting member 96 shown in FIG. 4 and FIGS. 11 through 14 depict the state obtaining when the respective attachment positions are set to the lowest attachment position relative to the outside control cylinder member 62, but the lower the attachment positions of the proximal flow-adjusting member 94 and the distal flow-adjusting member 96 are set relative to the outside control cylinder member 62, the larger is the setting of the opening surface area of opening portions 90*d* and 90*d'* relative to same.

The larger the opening surface areas of the opening portions 90*d* and 90*d'* are set to be, the larger is the flow of rinse water in the reservoir tank 22 flowing into the interior of the cylinder main body 90 from the opening portions 90*d* and 90*d'* on the cylinder main body 90 when the discharge valve apparatus 28 is discharged in the small flush mode, thereby enabling a higher setting for the quantity of rinse water supplied from the reservoir tank 22 discharge port 22*a* to the toilet main unit 2 in the small flush mode.

It happens that when the respective attachment positions of the proximal flow-adjusting member 94 and distal flow-adjusting member 96 relative to the outside control cylinder member 62 are set highest, the openings 90*d* and 90*d'* are respectively closed by the proximal flow-adjusting member 94 and the distal flow-adjusting member 96, and since the rinse water in the reservoir tank 22 cannot flow into the cylinder main body 90 from the opening portions 90*d* and 90*d'* in the cylinder main body 90 when the discharge valve apparatus 28 is discharged, the amount of rinse water supplied to the toilet main unit 2 from the reservoir tank 22 discharge port 22*a* in the small flush mode can be set to a minimum.

The proximal flow-adjusting member 94 is furnished with a blocking portion 94*a* for blocking the proximal openings 90*d* in the outside control cylinder member 62 when attached at a predetermined attachment position to the outside control cylinder member 62.

The male engaging portions 102 on the proximal flow-adjusting member 94 are provided on the side portion of the front surface side of the blocking portion 94*a* of the proximal flow-adjusting member 94, and are furnished with vertically extending frame-shaped protuberances 102*b* forming elongated holes 102*a*.

Moreover, the male engaging portions 106 on the proximal flow-adjusting member 94 are provided on the side portion of the rear surface side of the blocking portion 94*a* of the proximal flow-adjusting member 94, and are furnished with claw-shaped protuberances 106*a*, capable of engaging the registration indentations 108*a* in the female engaging portions 108 on the outside control cylinder member 62.

Similarly, the distal flow-adjusting member 96 is furnished with a blocking portion 96*a* for blocking the distal openings 90*d'* in the outside control cylinder member 62 when attached at a predetermined attachment position to the outside control cylinder member 62.

The male engaging portions 102' on the distal flow-adjusting member 96 are provided on the side portion of the rear surface side of the blocking portion 96*a* of the distal flow-adjusting member 96, and are furnished with vertically extending frame-shaped protuberances 102*b'* forming elongated holes 102*a'*.

Moreover, the male engaging portions 106' on the distal flow-adjusting member 96 are provided on the side portion of the front surface side of the blocking portion 96*a* of the distal flow-adjusting member 96, and are furnished with claw-shaped protuberances 106*a'*, capable of engaging the registration indentations 108*a'* in the female engaging portions 108 on the outside control cylinder member 62.

Note that the vertical height H of the proximal flow-adjusting member 94 blocking portion 96*a* is shorter than the vertical height H' of the distal flow-adjusting member 96 blocking portion 96*a*, but the length L of the blocking portion 94*a* in the front to rear direction is equal to the length L' of the blocking portion 96*a* in the front to rear direction.

Also, the frame-shaped protuberances 102*b* on the male engaging portions 102 of the proximal flow-adjusting member 94 and the frame-shaped protuberances 102*b'* on the male engaging portions 102' of the distal flow-adjusting member 96 have the same constitutions, as do the claw-shaped protuberances 106*a* on the male engaging portions 106 of the proximal flow-adjusting member 94 and the claw-shaped protuberances 106*a'* on the male engaging portions 106' of the distal flow-adjusting member 96.

Figure 13:
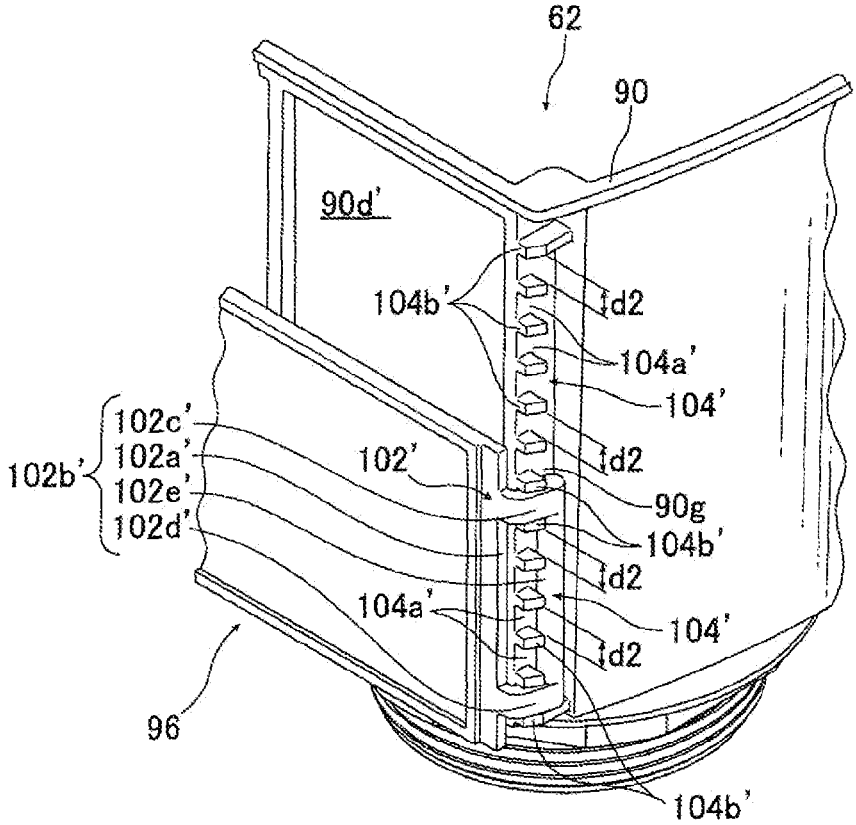
FIG. 13 is an expanded perspective view showing the state of engagement between a registration indentation on the female engaging portion at the rear surface of an outside control cylinder member and a frame-shaped protuberance on the male engaging portion of a distal side flow-adjusting member in a rinse water tank discharge valve apparatus according to a first embodiment of the present invention.

Therefore a discussion of the state of engagement between the frame-shaped protuberances 102*b* on the male engaging portions 102 of the proximal flow-adjusting member 94 and the registration indentations 104*a* on the female engaging portions 104 of the outside control cylinder member 62 is omitted, since it is the same as the state of engagement between the frame-shaped protuberances 102*b'* on the male engaging portions 102' of the distal flow-adjusting member 96 and the registration indentations 104*a'* on the female engaging portions 104' of the outside control cylinder member 62 shown in FIG. 13.

Figure 14:
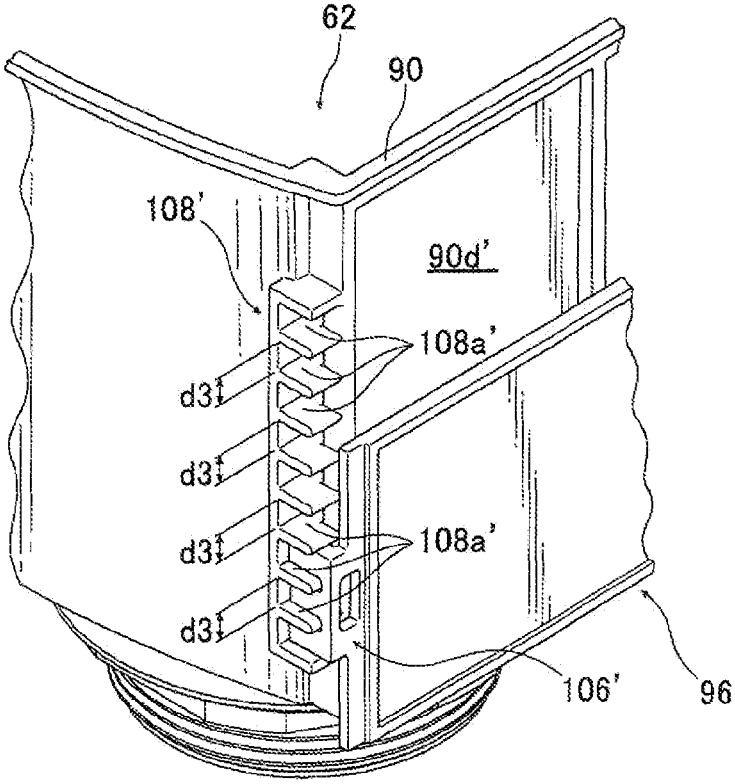
FIG. 14 is an expanded perspective view showing the state of engagement between an outside control cylinder member front surface female engaging portion registration indentation and the claw-shaped protuberance on the male engaging portion of the distal side flow-adjusting member in a rinse water tank discharge valve apparatus according to a first embodiment of the present invention.

The state of engagement between the claw-shaped protuberances 106*a* on the male engaging portions 106 of the proximal flow-adjusting member 94 and the registration indentations 108*a* on the female engaging portions 108 of the outside control cylinder member 62 is also the same as the state of engagement between the claw-shaped protuberances 106*a'* on the male engaging portions 106' of the distal flow-adjusting member 96 and the registration indentations 108*a'* on the female engaging portions 108' of the outside control cylinder member 62 shown in FIG. 14, so a discussion thereof is here omitted.

As shown in FIG. 13, the frame-shaped protuberances 102*b'* forming vertically extending elongated hole 102*a'* in the male engaging portions 102' of the distal flow-adjusting member 96 are furnished with a top end portion 102*c'*, a bottom end portion 102*d'*, and a columnar portion 102*e* extending from the bottom end portion 102*d'* to the top end portion 102*c'*.

Multiple indentation-forming protuberances 104*b*' protruding from inside outward and forming each of the registration indentations 104*a*' on the female engaging portions 104' on the outside control cylinder member 62 are vertically arrayed on the corner portion of the cylinder main body 90 on which the outside control cylinder member 62 female engaging portions 104' are positioned.

Here it is preferable for all the vertical intervals d2 in each of the registration indentations 104*a*' to be equal, corresponding to the vertical intervals between adjacent protuberances on each of the indentation-forming protuberances 104*b*', and set to a width narrower than the installers finger.

I.e., it is preferable to set the vertical intervals d2 in each of the registration indentations 104*a*' to 13 mm or below, and more preferable to set them at 5 mm or below.

Next, referring to FIGS. 13 through 16, the process for attaching the distal flow-adjusting member 96 to the outside control cylinder member 62 is explained.

Figure 15:
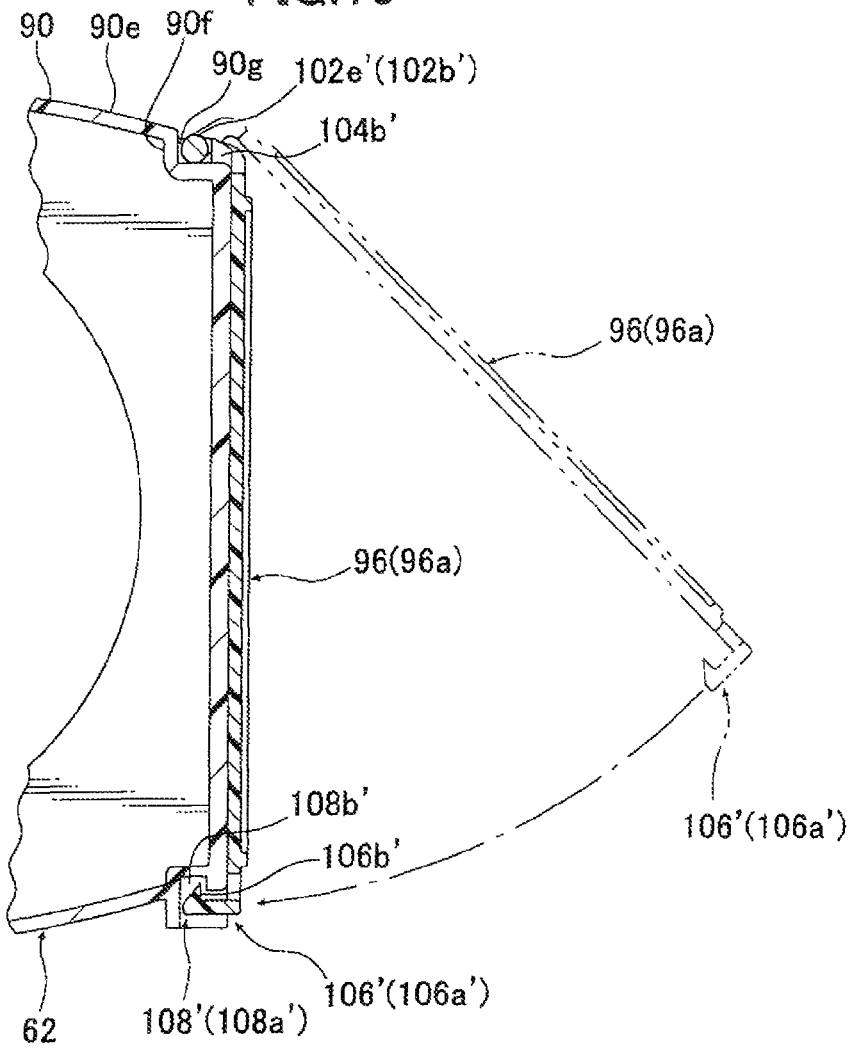
FIG. 15 is a partial plan view cross-section showing the state following the engagement of the frame-shaped protuberance on the male engaging portion of the distal side flow-adjusting member with the registration indentation on the female engaging portion at the rear surface side of the outside control cylinder member, up until the claw-shaped protuberance on the male engaging portion of the distal side flow-adjusting member is engaged with the registration indentation on the female engaging portion on the front surface of the outside control cylinder member, in a rinse water tank discharge valve apparatus according to a first embodiment of the present invention.
Figure 16:
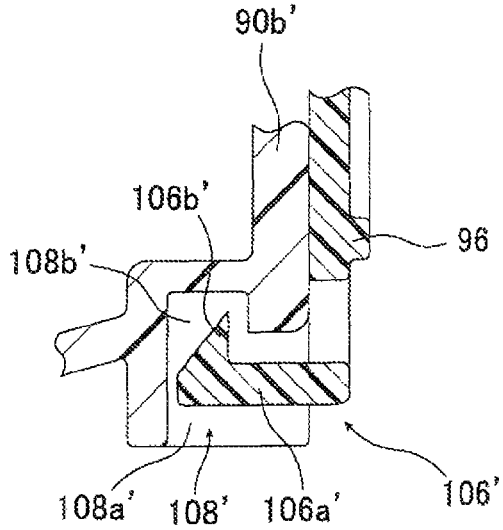
FIG. 16 is an expanded plan view showing the engaging portion between the registration indentation in the female engaging portion on the front surface side of an outside control cylinder member and the claw-shaped protuberance on the male engaging portion of the distal side flow-adjusting member, in a rinse water tank discharge valve apparatus according to a first embodiment of the present invention.

As shown in FIGS. 13 and 15, when the distal flow-adjusting member 96 is attached to the outside control cylinder member 62, the columnar portion 102*e*' of the frame-shaped protuberances 102*b*' on the distal flow-adjusting member 96 are first fit into indentations 90*g*, which are formed between the multiple indentation-forming protuberances 104*b*' forming each of the registration indentations 104*a*' on the female engaging portions 104' of the outside control cylinder member 62, and the side surface 90*f* rear surface sidewall portion 90*e* of the cylinder main body 90, and extend in the vertical direction.

By rotating the distal flow-adjusting member 96 toward the outside control cylinder member 62, centered on the columnar portion 102*e*', the top end portion 102*c*' and bottom end portion 102*d*' of the frame-shaped protuberances 102*b*' on the distal flow-adjusting member 96 are made to fit into their respectively opposing registration indentations 104*a*' in the female engaging portions 104' of the outside control cylinder member 62.

Next, after inserting the claw-shaped protuberances 106*a*' on the male engaging portions 106' of the distal flow-adjusting member 96 into their opposing registration indentations 108*a* in the female engaging portions 108' of the outside control cylinder member 62, the tip portion 106*b*' on the claw-shaped protuberance 106*a*' is fit into the indentation 108*b*' formed within the registration indentation 108*a*, thereby completing the attachment of the distal flow-adjusting member 96 to the outside control cylinder member 62.

Note that it is preferable for all the vertical intervals d3 in each of the registration indentations 108*a*' to be equal and to be set to a width narrower than the installers finger.

I.e., it is preferable to set the vertical intervals d3 in each of the registration indentations 108*a*' to 13 mm or below, and more preferable to set them at 5 mm or below.

Note that in the present embodiment as one a example a configuration, in which the engagement of the outside control cylinder member 62 with the proximal flow-adjusting member 94, and the engagement of the outside control cylinder member 62 with the distal flow-adjusting member 96 assumed engaging portions 104, 104', 108, and 108' on the outside control cylinder member 62 to be the respective female engaging portions and the engaging portions 102 and 106 on the proximal flow-adjusting member 94 and engaging portions 102' and 106' of the proximal flow-adjusting member 94 to be the respective male engaging portions, is explained, but the embodiment is not limited to such configurations, and it is also acceptable to exchange male and female between the female engaging portions and male engaging portions.

Note that in the present embodiment, with respect to the male engaging portions 102 and 106 on both sides of the proximal flow-adjusting member 94, and engaging portions 102' and 106' on both sides of the proximal flow-adjusting member 94, a configuration, in which, as an example, one of the male engaging portions 102 and 102' was assumed to be a frame-shaped protuberance 102*b* or 102*b*', while the other male engaging portions 106 and 106' were assumed to be claw-shaped protuberances 106*a* and 106*a*', mutually differing on each side, is explained, but the embodiment is not limited to such a configuration, and may also take the form whereby the engaging portions 102' and 106' on both sides of the proximal flow-adjusting member 94, and the engaging portions 102' and 106' on both sides of the distal flow-adjusting member 96, are the same claw-shaped engaging portions.

Using the discharge valve apparatus 28 and rinse water tank apparatus 18 furnished therewith of the first embodiment of the present embodiment, the vertical interval d1, within the indentations in the registration indentations 98*a* of the female engaging portions 98 on the inside control cylinder member 76 with which the male engaging portions 100 of the flow-adjusting member 92 engage, is set to be smaller than the width of an installer's finger. The vertical interval d2 within the indentation in the registration indentations 104*a* of the female engaging portions 104 on the outside control cylinder member 62 engaged by the male engaging portions 102 of the proximal flow-adjusting member 94, and the vertical interval d2 within the indentation in the registration indentations 104*a*' of the female engaging portions 104' on the outside control cylinder member 62 engaged by the male engaging portions 102' of the distal flow-adjusting member 96 are also set to be smaller than the width of the installer's hand. The vertical interval d3 within the indentation in the registration indentations 108*a* of the female engaging portions 108 on the outside control cylinder member 62 engaged by the male engaging portions 106 of the proximal flow-adjusting member 94, and the vertical interval d3 within the indentation in the registration indentations 108*a*' of the female engaging portions 108' on the outside control cylinder member 62 engaged by the male engaging portions 106' of the distal flow-adjusting member 96 are also set to be smaller than the width of the installer's hand. As a result of these things, situations can be prevented in which an installers finger penetrates into the various registration indentations 98*a*, 104*a*, 104*a*', 108*a*, and 108*a*', resulting in an operation releasing the engagement of the flow-adjusting member 92 male engaging portions 100 to the inside control cylinder member 76 female engaging portions 98, or releases the engagement of the proximal flow-adjusting member 94 male engaging portions 102 and 106 on the proximal flow-adjusting member 94 to the female engaging portions 104 and 108 on the outside control cylinder member 62, or releases the engagement of the male engaging portions 102' and 106' on the distal flow-adjusting member 96 to the female engaging portions 104' and 108' to the outside control cylinder member 62.

I.e., when the male engaging portions 100 on the flow-adjusting member 92 are engaged with the female engaging portions 98 of the inside control cylinder member 76, a state in which the male engaging portions 102 and 106 on the proximal flow-adjusting member 94 are respectively engaged in the female engaging portions 104 and 108 of the outside control cylinder member 62, and the state in which the male engaging portions 102', 106' on the distal flow-adjusting member 96 are respectively engaged in the female engaging portions 104' and 108' of the outside control cylinder member 62, these engagements cannot be easily released unless a tool or other means narrower than the width of the installer's hand is used, and a state in which the flow-adjusting member 92 can be easily removed from the inside control cylinder member 76 can be prevented from occurring, as can a state in which the proximal flow-adjusting member 94 and distal flow-adjusting member 96 can be easily removed from the outside control cylinder member 62.

As a result of these things, since the attachment position of the flow-adjusting member 92 relative to the inside control cylinder member 76 cannot be easily changed through installer error when installing the rinse water tank apparatus 18 or the discharge valve apparatus 28, the attachment position of the proximal flow-adjusting member 94 and the distal flow-adjusting member 96 relative to the outside control cylinder member 62 cannot be easily changed, therefore easy onsite regulation by the installer of the rinse water amount supplied to the toilet main unit 2 from the reservoir tank 22 can be prevented, and an appropriate present rinse water amount can be supplied to the toilet main unit 2.

Moreover, using the discharge valve apparatus 28 and rinse water tank apparatus 18 furnished therewith of the present embodiment, when the proximal flow-adjusting member 94 and distal flow-adjusting member 96 are engaged in the outside control cylinder member 62, in a state of engagement between the respective frame-shaped protuberances 102*b* and 102*b*' of the male engaging portions 102 and 102' with the registration indentations 104*a*' and 104*a*' on the female engaging portions 104 and 104' of the outside control cylinder member 62, the respective claw-shaped protuberances 106*a* and 106*a*' on the male engaging portions 106 and 106' of the proximal flow-adjusting member 94 and distal flow-adjusting member 96 can be easily caused to engage the registration indentations 108*a* and 108*a*' on the female engaging portions 108 and 108' of the outside control cylinder member 62. Therefore the proximal flow-adjusting member 94 and the distal flow-adjusting member 96 can respectively be easily attached to the outside control cylinder member 62, and ease of assembly of the proximal flow-adjusting member 94 and the distal flow-adjusting member 96 to the outside control cylinder member 62 can be improved.

Once the respective male engaging portions 102, 102', 106, and 106' of the proximal flow-adjusting member 94 and the distal flow-adjusting member 96 are respectively engaged with the female engaging portions 104, 104', 108, and 108', the engagement between the respective male engaging portions 102, 102', 106, and 106' of the proximal flow-adjusting member 94 and the distal flow-adjusting member 96 cannot be easily released unless the installer uses a tool or other means narrower in width than the installer's fingers, and a state can be prevented whereby the proximal flow-adjusting member 94 and the distal flow-adjusting member 96 can be easily removed from the outside control cylinder member 62. Therefore since the attachment position of the proximal flow-adjusting member 94 and the distal flow-adjusting member 96 relative to the outside control cylinder member 62 cannot be easily changed through installer error when installing the rinse water tank apparatus 18 or the discharge valve apparatus 28, easy onsite regulation by the installer of the rinse water amount supplied to the toilet main unit 2 from the reservoir tank 22 can be prevented, and an appropriate pre-set rinse water amount can be supplied to the toilet main unit 2.

Using the discharge valve apparatus 28 and the rinse water tank apparatus 18 furnished therewith of the present embodiment, the female engaging portions 98 on the inside control cylinder member 76 are integrally formed with the wall portions 76*e* on both sides of the opening 76*a* in the inside control cylinder member 76; the female engaging portions 104 and 108 of the outside control cylinder member 62 are integrally formed on the proximal sidewall 90*b* of the cylinder main body 90; and the female engaging portions 104' and 108' of the outside control cylinder member 62 are integrally formed on the proximal sidewall 90*b*' of the cylinder main body 90, hence there is no need to provide a separate means for preventing easy release of engagement of the flow-adjusting member 92 to the inside control cylinder member 76 and the engagement of the proximal flow-adjusting member 94 and distal flow-adjusting member 96 to the outside control cylinder member 62 beyond the registration indentations 104*a*, 104*a*', 108*a*, and 108*a*' on the outside control cylinder member 62, therefore easy changing through installer error of the attachment positions of the flow-adjusting members 92, 94, or 96 relative to the inside control cylinder member 76 and the outside control cylinder member 62 at the time of installation of the rinse water tank apparatus 18 or the discharge valve apparatus 28 can be prevented using a simple structure. An appropriate pre-set amount of rinse water can therefore be supplied to the toilet main unit 2.

Although the present invention has been explained with reference to specific, preferred embodiments, one of ordinary skill in the art will recognize that modifications and improvements can be made while remaining within the scope and spirit of the present invention. The scope of the present invention is determined solely by appended claims.

What is claimed is:

1. A discharge valve apparatus on a rinse water tank for storing rinse water for flushing a toilet, said apparatus comprising:

a valve body for opening and closing a discharge port disposed on a bottom surface of a rinse water tank;

a control cylinder member for controlling flow of rinse water flowing out of the discharge port from the rinse water tank when the valve body releases the discharge port, an opening portion being formed in the control cylinder member to permit rinse water to pass through the control cylinder member; and an adjusting member attached at a changeable predetermined attachment position on the control cylinder member and the adjusting member being capable of adjusting an opening surface area of the opening portion in the control cylinder member according to the changeable predetermined attachment position;

the control cylinder member and the adjusting member being respectively furnished with engaging portions by which they mutually engage, and one of the control cylinder member engaging portion and the adjusting member engaging portion being a male engaging portion, while the other of the control cylinder member engaging portion and the adjusting member engaging portion being a female engaging portion;

the female engaging portion being arrayed in essentially a straight line fashion, and being furnished with a registration indentation for registering the changeable predetermined attachment position of the adjusting member relative to the control cylinder member, and a gap within said registration indentation being set to be smaller than a width of an installer's finger, so that a manipulation by an installer's finger to release the engagement between the male engaging portion and the female engaging portion is prevented when the adjusting member engaging portion is in a state of engagement with the control cylinder member engaging portion.

2. The discharge valve apparatus according to claim 1, wherein the adjusting member engaging portion is the male engaging portion, and the control cylinder member engaging portion is the female engaging portion; the adjusting member is furnished with a blocking portion for blocking the opening portion of the control cylinder member when the adjusting member is attached at a predetermined attachment position on the control cylinder member, and the male engaging portion of the adjusting member is furnished with a claw-shaped protuberance disposed on at least one side portion of the blocking portion, and is capable of engaging the registration indentation on the female engaging portion of the control cylinder member.

3. The discharge valve apparatus according to claim 2, wherein the male engaging portion of the adjusting member is furnished with a frame-shaped protuberance disposed on the at least one side portion of the blocking portion and forming a vertically extending elongated hole; the frame-shaped protuberance engages with the registration indentation on one side of the opposing female engaging portion of the control cylinder member, and when the frame-shaped protuberance and the registration indentation are mutually engaged on one side, the claw-shaped protuberance engages the registration indentation on the other side of the female engaging portion on the control cylinder member opposite the claw-shaped protuberance.

4. The discharge valve apparatus according to claim 1, wherein the control cylinder member is furnished with a side wall on which the opening portion is formed, and the registration indentation on the female engaging portion of the control cylinder member is integrally formed on the side wall.

5. The discharge valve apparatus according to claim 1, wherein the gap in the registration indentation of the female engaging portion is 13 mm or less.

6. A rinse water tank apparatus furnished with the discharge valve apparatus according to claim 1.

* * * * *